United States Patent [19]

Foulard et al.

[11] 4,309,214

[45] Jan. 5, 1982

[54] MANUFACTURE OF METAL POWDER

[75] Inventors: Jean Foulard, Ablonsur Seine; Gerard Bentz, Elancourt-Trappes; Jean Galey, Voisins Bretonneux, all of France

[73] Assignee: L'Air Liquide, Societe Anonyme pour l'Etude et l'Exploitation des Procedes Georges Claude, Paris, France

[21] Appl. No.: 70,036

[22] Filed: Aug. 27, 1979

[30] Foreign Application Priority Data

Sep. 18, 1978 [FR] France ..... 78 26648

[51] Int. Cl.[3] ..... B22D 23/08

[52] U.S. Cl. ..... 75/0.5 B; 75/0.5 C; 75/157.5

[58] Field of Search ..... 75/0.5 R, 0.5 B, 0.5 BA, 75/0.5 BB, 0.5 BC, 0.5 C, 157.5; 241/23; 264/5, 13, 14

[56] References Cited

U.S. PATENT DOCUMENTS 3,042,511 7/1962 Reding, Jr. ..... 75/0.5 B
3,151,971 10/1964 Clough ..... 75/0.5 B
3,165,396 1/1965 Goon ..... 75/0.5 B
3,856,513 12/1974 Chen et al. ..... 75/123 D
4,124,377 11/1978 Larson ..... 75/0.5 C
4,169,730 10/1979 Matthews et al. ..... 75/157

FOREIGN PATENT DOCUMENTS 48-2666 6/1967 Japan ..... 241/23
46-25620 7/1971 Japan ..... 75/0.5 B

OTHER PUBLICATIONS

Barnhart, C. L., et al., ed., *The American College Dictionary* Random House p. 292 (1970).

*Primary Examiner*—Michael L. Lewis
*Attorney, Agent, or Firm*—Lee C. Robinson, Jr.

[57] ABSTRACT

A system for producing metal powder in which a cryogenic fluid in the liquid phase is poured over a metal bath having a vapor pressure of at least 1 mm Hg, and the solid particles suspended in the fluid are separated therefrom and collected.

The particles find application in the manufacture of paints, in the treatment of rubber, and in the metallurgical, chemical pharmaceutical and ceramic industries.

14 Claims, 3 Drawing Figures

MANUFACTURE OF METAL POWDER

BACKGROUND OF THE INVENTION

This invention relates to the production of metal powder by reducing the temperature of the vapor of a bath of molten metal.

The present invention, while of general application, is particularly well suited for the production of metal powder through reduction of the temperature of the vapor of a molten metallic material in a closed treating enclosure to convert the vapor to solid particles.

The term "metallic material" designates either a metal or an alloy of two or more metals.

"Metal powder" means a powder formed of solid particles comprising a single metal such as iron, zinc, magnesium, calcium, cadmium, etc., or a metal alloy, for example, a magnesium-zinc alloy, or metallic compound such as zinc oxide or magnesium nitride. Such powders are widely used in various industries, and particularly in the manufacture of paints, in the treatment of rubbers, in the metallurgical industry (sintered materials), chemical industry (catalysts), ceramic industry, pharmaceutical industry, etc.

A method of producing metal powder from a molten metal is already known in which the vapor of the molten metal is swept with a previously cooled inert gas to bring about the condensation of the vapor. However, with this method the cooling action is minimal, and the method does not lend itself to the production of powder in large quantities. Moreover, the powder obtained is of irregular shape and varies widely in size.

SUMMARY

One general object of this invention, therefore, is to provide a new and improved method and apparatus for producing metal powder by reducing the temperature of the vapor of a molten metallic material.

More specifically, it is an object of the invention to provide such a method and apparatus for producing industrial quantities of extremely fine divided powders having an average particle size of the order of 0.08 microns.

Another object of the invention is to provide a method and apparatus of the character indicated in which the particles exhibit as regular a shape and as little size variation as possible, that is to say, being in the size range from 0.02 to 0.15 microns.

Still another object of the invention is to provide a method and apparatus for producing metal powder of high chemical purity.

These objectives are achieved, in accordance with a preferred embodiment of the invention, by pouring a cryogenic fluid in the liquid phase over a molten metal bath after the latter has been brought to such temperature that its vapor pressure is at least 1 mm Hg. The cryogenic fluid containing the solid particles in suspension is evacuated from the enclosure, and the particles are then separated from the fluid and are collected in powder form.

Tests conducted with various metallic materials (pure metals or alloys) have shown that the vapor pressure preferably should be maintained between 1 and 500 mm Hg. A vapor pressure within this range results in accelerated vaporization of the metal bath and therefore renders the method particularly well suited for use on an industrial scale.

The use of a cryogenic fluid in the liquid phase produces very rapid cooling, and hence a vigorous quench, of the metal vapor and permits it to pass from the gaseous state directly to the solid state. As a result of the abruptly cooled incipient metal vapor, the powder particles are of regular shape and their size does not exceed a few hundred angstroms.

In accordance with another characteristic of certain important embodiments of the invention, the cryogenic fluid is introduced into and evacuated from the enclosure on a continuous basis. The flow rate of the fluid is controlled to provide continuous powder production at an optimum rate of particle formation.

In accordance with several embodiments of the invention the cryogenic fluid is evacuated in the liquid phase, while in other arrangements the fluid is evacuated in the gaseous phase. Each particular installation in the practice of the invention is designed to discharge the fluid in a phase consistent with the design objectives of the system.

In accordance with yet another characteristic of the invention, in several advantageous embodiments, the cryogenic fluid is formed of a chemically inert element or of a mixture of chemically inert elements. The use of such a cryogenic fluid greatly facilitates the production of metal powders formed of chemically pure metals.

In accordance with other embodiments of the invention, the cryogenic fluid is formed of a chemically reactive element. These latter fluids are used to produce specific chemical compounds such as metal oxides, nitrides or hydrides, for example.

In accordance with still other embodiments of the invention, the cryogenic fluid is formed of a mixture of chemically reactive elements. The mixture may be controlled to provide powders of a wide variety of chemical compounds.

The invention further provides for an installation for the practice of the method. In a preferred embodiment of the installation a cryogenic fluid in the liquid phase is continuously poured into a closed enclosure. A stream of fluid carrying the solid metal particles in suspension is removed from the enclosure and is introduced into a closed separating chamber. The separating chamber is provided with apparatus for collecting the solid particles and for evacuating the fluid stream.

Other characteristics and advantages of the invention will become apparent in the course of the following description of certain preferred embodiments when read with reference to the accompanying drawings.

DESCRIPTION OF CERTAIN PREFERRED EMBODIMENTS

Figure 1:
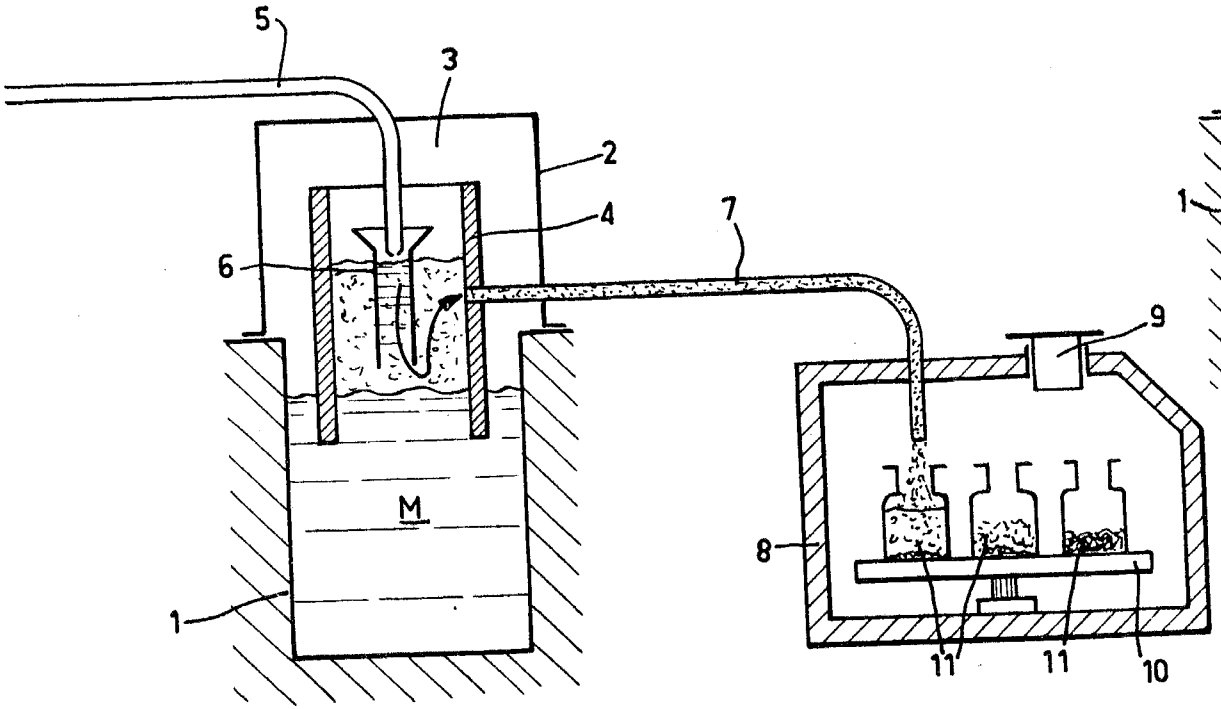
FIG. 1 is a diagrammatic illustration of an installation for the practice of the method in accordance with the invention wherein the cryogenic fluid is evacuated in the liquid phase, the particles being collected by gravity.

In accordance with the embodiment shown in FIG. 1, the installation comprises a melting unit 1, for example, an induction furnace or a heated crucible, which contains the metallic material M in the liquid state. The unit 1 is closed by a cover 2 to create an enclosure 3 above the molten metal bath. The bath is thus isolated from the ambient atmosphere, and the metal vapor is maintained within the enclosure.

Located within the enclosure 3 is a reactor 4. The reactor 4 is formed by an upstanding tubular sleeve slightly smaller in cross section than the enclosure 3 and open at both ends. The lower end of the reactor 4 is immersed slightly into the metal bath M, and the bulk of the vapor phase of the metallic material is concentrated in the reactor.

The furnace unit 1 and the reactor 4 may be constructed of any refractory material commonly used in metallurgy, the furnace being provided with a suitable heater (not shown) whereby the molten metal is maintained at the temperature necessary for obtaining the desired vapor pressure. A cryogenic fluid, such as liquified nitrogen at −196° C., is fed through an inlet pipe 5 into the reactor 4. The fluid is received by a funnel 6 disposed in the reactor and emptying close to the surface of the metal bath so that the fluid is discharged from the funnel just above the bath. The reactor 4 is connected by a heat-insulated pipe 7 to a closed separating chamber 8 which communicates with the atmosphere only through a pressure-limiting one-way valve 9. The chamber 8 contains receptacles 11 for the collection of the particles, these receptacles being mounted on a rotary support 10 so that they may be placed in turn under the pipe 7.

The reactor 4 is supplied with cryogenic liquid at a rate sufficient to continuously maintain a thick layer of cryogenic liquid above the metal bath M. The layer of liquid extends above the level at which the pipe 7 is connected to the reactor 4. The solid particles forming in the reactor 4 upon the condensation of the metal vapors remain in suspension in the cryogenic liquid, and the liquid and solid particles are drawn off through the pipe 7 into the separating chamber 8. The cryogenic liquid then passes into the gaseous state, creating and maintaining a neutral atmosphere in the chamber 8. The solid particles separate by gravity within the chamber and drop into the receptacles 11, where they are collected in powder form. In most cases these receptacles are filled in several stages in view of the dimunition of the volume of the powder attendant upon the evaporation of the cryogenic liquid. Such successive filling may be readily accomplished through the use of the rotary support 10.

In some embodiments the chamber 8 is maintained at a pressure which is less than that within the reactor 4 and the evacuating pipe 7. The liquid phase of the cryogenic fluid is withdrawn by suction from the reactor with the solid particles in suspension therein.

Figure 2:
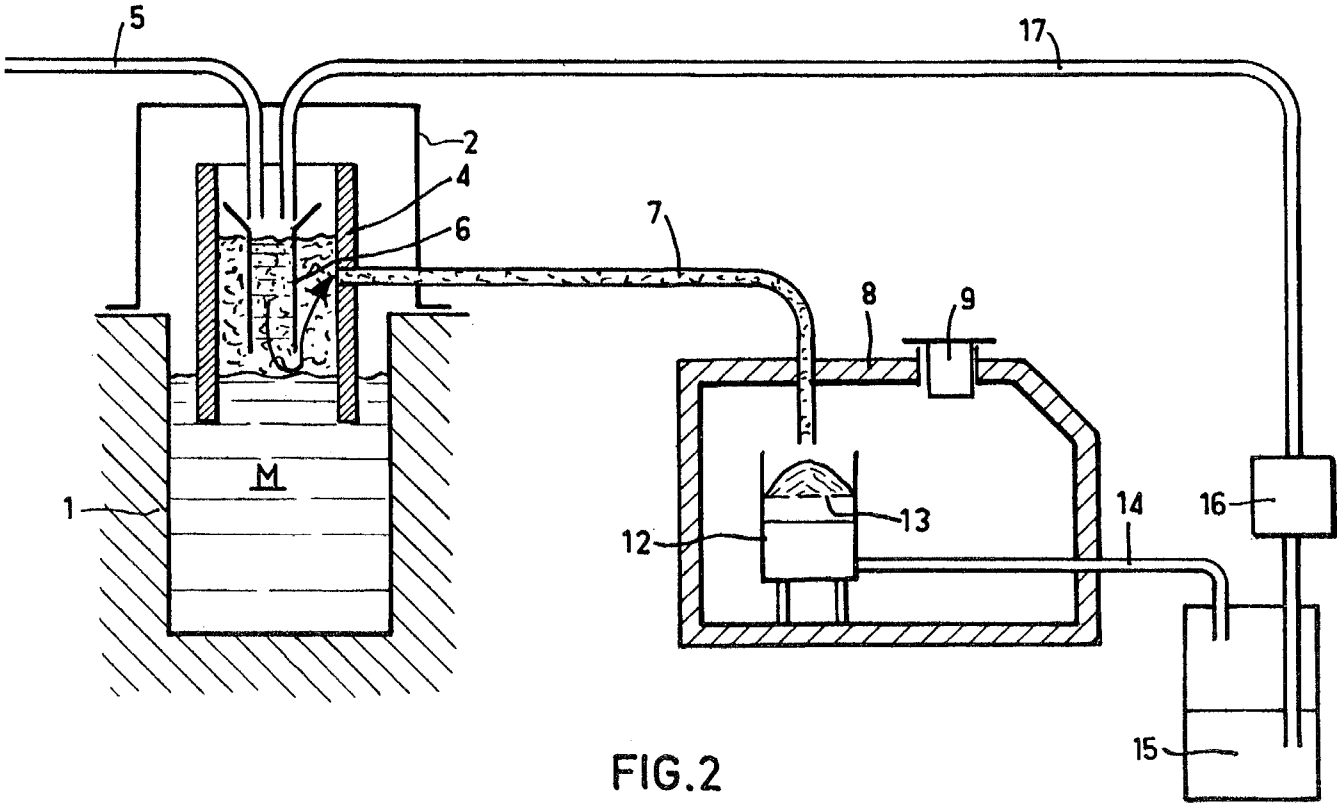
FIG. 2 is a diagrammatic illustration similar to FIG. 1 but showing an installation wherein the particles are collected by filtration.

In accordance with the embodiment shown in FIG. 2, where the same reference numerals designate the same parts as in FIG. 1, the cryogenic liquid, charged with metal particles in suspension and conducted to the separating chamber 8 through the pipe 7, is received in one or more separating vessels 12. Each of the vessels 12 is provided with a filtering wall 13 which retains the particles while passing the liquid. The thus filtered liquid is conducted through a heat-insulated pipe 14 to a recovery vessel 15 and is then returned to the reactor 4 through a recycling pump 16 and a heat-insulated pipe 17 to augment the supply of liquid to the reactor through the heat-insulated pipe 5.

Figure 3:
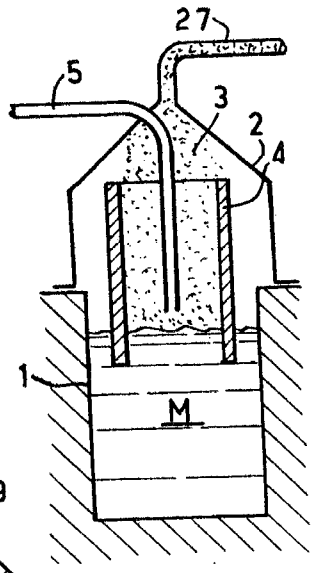
FIG. 3 is a partial diagrammatic view of an installation wherein the cryogenic fluid is evacuated in the gaseous phase.

According to the embodiment of FIG. 3, the reactor 4 is supplied with cryogenic liquid at a rate insufficient for maintaining a liquid layer above the metal bath. In this latter embodiment the vapor from the metal bath is condensed at the point where the cryogenic liquid impinges on the surface of the bath, and the liquid rapidly vaporizes to carry the resulting metal particles toward the upper portion of the enclosure 2. The particles and the fluid in the vapor phase are discharged from the enclosure 2 by a heat-insulated pipe 27 connected to the upper end of the enclosure. The particles are then recovered by gravity in the manner described heretofore.

In each of the illustrated embodiments the metallic material may be formed of a metal (iron, copper, zinc, magnesium, aluminum, etc.) or of an alloy (brass, bronze, etc.).

It should be noted that in the latter case the kinetics of the vaporization may be controlled by proper selection of the composition of the alloy, that is to say, by the choice of constituents having different melting temperatures and by the proportions of these constituents. For example, an alloy with a high proportion of a metal having a low melting point, such as magnesium, permits the production of a metal vapor formed almost exclusively of that low melting-point metal. Similarly, when an alloy of copper (a metal of low volatility) and zinc (a highly volatile metal) is employed, the composition of the alloy and the temperature of the metal bath may be chosen so that the solid particles obtained will be solely of zinc.

The cryogenic fluid may be formed of one or more liquified inert elements (nitrogen, argon, helium, etc.) or reactive elements (oxygen, hydrogen, ammonia, etc.), of liquified compounds such as hydrocarbons, of a mixture of liquified inert elements and liquified reactive elements, or of a mixture of liquified inert elements and liquified compounds. In the case of such mixtures, the percentage of the reactive element or of the compound will determine the kinetics of the reaction of combination of the metal with the metalloid forming the reactive elements or deriving from the decomposition of the compound.

An example of the production of a zinc powder from a copper-zinc alloy in accordance with the embodiment of FIG. 1 follows:

| | |
|---|---|
| Metallic material: | 70% copper, 30% zinc (UZ 30 alloy French standard) |
| Temperature of metal bath: | 1065° C. |
| Vapor pressure of zinc: | 486 mm Hg |
| Vapor pressure of copper: | $10^{-4}$ mm Hg |
| Mole fraction of zinc: | 0.3 |
| Reactivity of zinc in alloy: | 0.16 |
| Coefficient of reactivity of zinc in alloy: | 0.54 |
| Cryogenic fluid: | Liquid nitrogen (−196° C.) |

The powder obtained after separation of the cryogenic fluid was formed of zinc particles of a size ranging between 0.03 and 0.10 microns and had a specific surface (BET) of 40 $m^2/g$.

With a copper-zinc alloy the zinc may be superheated to obtain a high vapor pressure of the zinc relative to the vapor pressure of the copper so that the metal particles produced are formed exclusively of zinc.

The method described above may be modified in many ways without departing from the scope of the invention. For example, the furnace 1 may be heated by induction or by radiation, including solar radiation concentrated by means of an optical system or radiation produced by a laser, or by means of an arc or of electrical resistance to secure localized or complete melting and superheating of the material to be vaporized. Plasma heating, too, may be employed. Similarly, another inert gas such as argon may be used in place of nitrogen.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A method of producing a metal powder which comprises, in combination:

heating a metallic material in a closed treating enclosure until the vapor pressure of the material is at least about 1 mm Hg;

pouring sufficient cryogenic fluid in the liquid phase to maintain a thick layer of fluid over the thus heated metallic material and thereby condense vapor from the material and form a multiplicity of solid particles;

evacuating the cryogenic fluid from the enclosure with the solid particles in suspension;

separating the solid particles from the cryogenic fluid; and collecting the solid particles in powder form.

2. A method of producing a metal powder as defined in claim 1, in which the cryogenic fluid is continuously introduced into and evacuated from the enclosure.

3. A method of producing a metal powder as defined in claim 1, in which the cryogenic fluid comprises a chemically inert element.

4. A method of producing a metal powder as defined in claim 1, in which the cryogenic fluid comprises a chemically reactive element.

5. A method of producing a metal powder as defined in claim 1, in which the cryogenic fluid comprises a mixture of a chemically inert element and a chemically reactive element.

6. A method of producing a metal powder which comprises, in combination:

heating a metallic material in a closed treating enclosure until the vapor pressure of the material is at least about 1 mm Hg;

pouring sufficient cryogenic fluid in the liquid phase to maintain a thick layer of fluid over the thus heated metallic material and thereby condense vapor from the material and form a multiplicity of solid particles;

evacuating the cryogenic fluid from the enclosure in the liquid phase with the solid particles in suspension therein;

separating the solid particles from the cryogenic fluid; and collecting the solid particles in powder form.

7. A method of producing a metal powder as defined in claim 6, in which the liquid phase is evacuated from the enclosure by suction.

8. A method of producing a metal powder which comprises, in combination:

heating a metallic material in a closed treating enclosure until the vapor pressure of the material is at least about 1 mm Hg;

pouring sufficient cryogenic fluid in the liquid phase to maintain a thick layer of fluid over the thus heated metallic material and thereby condense vapor from the material and form a multiplicity of solid particles;

evacuating the cryogenic fluid from the enclosure in the gaseous phase with the solid particles in suspension therein;

separating the solid particles from the cryogenic fluid; and collecting the solid particles in powder form.

9. A method for producing a metal powder which comprises, in combination:

heating a metallic material in a closed treating enclosure until the vapor pressure of the material is at least about 1 mm Hg;

pouring sufficient cryogenic fluid in the liquid phase to maintain a thick layer of fluid over the thus heated metallic material and thereby condense vapor from the material and form a multiplicity of solid particles;

evacuating the cryogenic fluid from the enclosure with the solid particles in suspension;

filtering the evacuated cryogenic fluid to separate the solid particles therefrom; and collecting the solid particles in powder form.

10. A method of producing a metal powder which comprises, in combination:

heating a metallic material in a closed treating enclosure until the vapor pressure of the material is at least about 1 mm Hg;

pouring liquid nitrogen over the thus heated metallic material to condense vapor from the material and form a multiplicity of solid particles;

evacuating the nitrogen fluid from the enclosure with the solid particles in suspension;

directing the nitrogen fluid and the suspended solid particles into a separating enclosure spaced from the treating enclosure;

separating the solid particles from the nitrogen fluid in said separating enclosure; and collecting the solid particles in powder form.

11. A method of producing a metal powder as defined in claim 10, in which the solid particles are separated by gravity from the nitrogen within said separating enclosure.

12. A method of producing a metal powder as defined in claim 10, in which said material is a substantially pure metal.

13. A method of producing a metal powder as defined in claim 10, in which said material is an alloy of two or more metals.

14. A method of producing a metal powder which comprises, in combination:

heating a copper-zinc alloy in a closed treating enclosure to a temperature of about 1065° C. until the vapor pressure of the alloy is at least about 1 mm HG;

pouring liquid nitrogen over the thus heated alloy to condense vapor from the alloy and form a multiplicity of solid particles;

evacuating the nitrogen from the enclosure with the solid particles in suspension;

separating the solid particles from the nitrogen; and collecting the solid particles in powder form.

* * * * *